US010295220B1

(12) United States Patent
Lewis et al.

(10) Patent No.: US 10,295,220 B1
(45) Date of Patent: May 21, 2019

(54) SNOW REMOVAL ASSEMBLY, APPARATUS AND METHOD FOR AIR HANDLING UNITS

(71) Applicant: ACME MANUFACTURING CORPORATION, Claremore, OK (US)

(72) Inventors: Harold A. Lewis, Tulsa, OK (US); Scott C. Lewis, Tulsa, OK (US)

(73) Assignee: ACME MANUFACTURING CORPORATION, Claremore, OK (US)

( * ) Notice: Subject to any disclaimer, the term of this patent is extended or adjusted under 35 U.S.C. 154(b) by 899 days.

(21) Appl. No.: 14/540,726

(22) Filed: Nov. 13, 2014

(51) Int. Cl.
*F24F 13/28* (2006.01)

(52) U.S. Cl.
CPC ..... *F24F 13/28* (2013.01)

(58) Field of Classification Search
CPC ..... F24F 13/28
USPC ..... 454/275
See application file for complete search history.

(56) References Cited

U.S. PATENT DOCUMENTS 4,321,064 A 3/1982 Vargo
4,498,660 A 2/1985 Brema et al.
5,184,800 A 2/1993 Tabler
5,791,984 A * 8/1998 Kane ..... F24F 13/08 219/201
6,328,778 B1 * 12/2001 Richerson ..... B01D 46/0002 55/475
6,401,934 B1 * 6/2002 Largent ..... B01D 29/012 209/401
6,540,805 B2 4/2003 Ohno et al.
6,589,111 B1 7/2003 Giroux
7,740,530 B2 6/2010 Astourian
7,836,643 B2 11/2010 Herrington
7,857,291 B2 12/2010 Dombroski
8,167,980 B2 5/2012 Hiner et al.
8,349,043 B2 1/2013 Jarrier
8,387,546 B2 3/2013 David
2002/0083836 A1 * 7/2002 Doi ..... B01D 46/0023 95/278
2007/0264922 A1 * 11/2007 Astourian ..... F24F 13/082 454/43
2008/0086981 A1 4/2008 Kilkis et al.
2009/0053543 A1 * 2/2009 Reiff ..... B01D 39/12 428/480
2012/0031272 A1 2/2012 Rubit et al.
2013/0305926 A1 11/2013 Raether
(Continued)

*Primary Examiner* — Steven B McAllister
*Assistant Examiner* — Allen R Schult
(74) *Attorney, Agent, or Firm* — Dennis D. Brown; Brown Patent Law, P.L.L.C.

(57) ABSTRACT

An air handling system and an apparatus and method for removing snow from the intake air for the air handling system. The apparatus includes a sequence of snow fence panels which each have alternating filter areas and open flow areas. The locations of the filter areas and open flow areas in each succeeding panel alternate so that a filter area in one panel is positioned in front of an open area in the next panel. During an extreme snow event, if the snow clogs the filter elements, the air continues to flow through the alternating open flow areas, which creates low pressure zones behind the clogged filter elements. The snow separates from the air flow in the low pressure zones and is retained in the low pressure zones by horizontal collection pans.

17 Claims, 8 Drawing Sheets

(56) References Cited

U.S. PATENT DOCUMENTS

2015/0117964 A1* 4/2015 Etyemezian ..... E02D 3/00
405/302.6

* cited by examiner

SNOW REMOVAL ASSEMBLY, APPARATUS AND METHOD FOR AIR HANDLING UNITS

FIELD OF THE INVENTION

The present invention relates to air handling systems and to assemblies, apparatuses and methods for removing snow from the intake air to these systems.

BACKGROUND OF THE INVENTION

The large heating, ventilation and air conditioning (HVAC) systems used in health care facilities, schools, clean room facilities, laboratories, public buildings, and other facilities cannot afford to shut down during snow events. Accumulation of snow in a building's air intake plenums can interfere with the proper functioning of the HVAC system and cause operational disruptions, corrosion, and other costly problems.

A need exists for an improved apparatus and method which are highly effective for removing snow from the air intake of HVAC systems and other air handling units (AHUs), even during major or extreme snow events.

SUMMARY OF THE INVENTION

The present invention provides an assembly apparatus and method which satisfy the needs and alleviate the problems discussed above.

In one aspect, there is provided an apparatus for removing snow from an intake air stream for an air handling unit comprising: (a) a first panel having a plurality of filter elements and a plurality of open flow areas and (b) a second panel adjacent to and downstream of the first panel. The second panel has a plurality of open flow areas which are positioned behind and in alignment with the filter elements of the first panel. The second panel also has a plurality of filter elements which are positioned behind and in alignment with the open flow areas of the first panel. The filter elements of the first panel have upstream (forward) faces and the filter elements of the second panel have upstream faces which are preferably not more than 30 inches, more preferably from about 12 to about 24 inches, downstream of the upstream faces of the filter elements of the first panel.

The apparatus preferably also comprises at least one snow collection pan having an upper surface, wherein at least an upstream portion of the upper surface extends from the second panel toward the first panel. More preferably, the upper surface of the snow collection pan extends from the second panel toward one of the filter elements of the first panel and the upper surface of the snow collection pan is positioned at an elevation in the apparatus which is preferably substantially the same as an elevation of a bottom edge of the one filter element or is higher than the elevation of the bottom edge of the one filter element by a distance which is preferably not more than ⅓ of the installed vertical height of the one filter element.

In addition, it is preferred that the apparatus further comprise a third panel adjacent to and downstream of the second panel. The third panel has (a) a plurality of open flow areas which are positioned behind and in alignment with the filter elements of the second panel and (b) a plurality of filter elements which are positioned behind and in alignment with the open flow areas of the second panel. The filter elements of the third panel have upstream faces which are preferably not more than 30 inches, more preferably from about 12 to about 24 inches, downstream of the upstream faces of the filter elements of the second panel.

In another aspect, there is provided an assembly for removing snow from an intake air stream for an air handling unit. The assembly comprises: a louvered or other air inlet structure for at least blocking larger debris; a first panel downstream of the air intake structure, the first panel having a plurality of filter elements and a plurality of open flow areas; and a second panel adjacent to and downstream of the first panel. The second panel has a plurality of open flow areas which are positioned behind and in alignment with the filter elements of the first panel. The second panel also has a plurality of filter elements which are positioned behind and in alignment with the open flow areas of the first panel. The filter elements of the first panel have upstream faces and the filter elements of the second panel have upstream faces which are preferably not more than 30 inches, more preferably from about 12 to about 24 inches downstream of the upstream faces of the filter elements of the first panel.

The assembly preferably also comprises a third panel adjacent to and downstream of the second panel. The third panel has a plurality of open flow areas which are positioned behind and in alignment with the filter elements of the second panel. The third panel also has a plurality of filter elements which are positioned behind and in alignment with the open flow areas of the second panel. The filter elements of the third panel have upstream faces which are preferably not more than 30 inches, more preferably from about 12 to about 24 inches, downstream of the upstream faces of the filter elements of the second panel.

In addition, the assembly preferably further comprises at least one snow collection pan having an upper surface, wherein at least an upstream portion of the upper surface extends from the third panel, beyond the second panel, toward the first panel.

In another aspect, there is provided an air handling system comprising: an air intake plenum having an air inlet structure for at least blocking larger debris (e.g., trash or other flying debris); a first panel positioned in the air intake plenum, the first panel being downstream of the air intake structure; a second panel positioned in the air intake plenum adjacent to and downstream of the first panel; and at least one fan or blower downstream of the second panel. The first panel has a plurality of filter elements and a plurality of open flow areas. The second panel has a plurality of open flow areas which are positioned behind and in alignment with the filter elements of the first panel. The second panel also has a plurality of filter elements which are positioned behind and in alignment with the open flow areas of the first panel. The filter elements of the first panel have upstream faces and the filter elements of the second panel have upstream faces which are preferably not more than 30 inches, more preferably from about 12 to about 24 inches, downstream of the upstream faces of the filter elements of the first panel.

The air handling system also preferably comprises a third panel positioned in the air intake plenum adjacent to and downstream of the second panel. The third panel has a plurality of open flow areas which are positioned behind and in alignment with the filter elements of the second panel. The third panel also has a plurality of filter elements which are positioned behind and in alignment with the open flow areas of the second panel. The filter elements of the third panel have upstream faces which are preferably not more than 30 inches, more preferably from about 12 to about 24 inches, downstream of the upstream faces of the filter elements of the second panel. The fan or blower is positioned downstream of the third panel, when the third panel is present.

In addition, the air handling system preferably further comprises at least one snow collection pan having an upper surface, wherein at least an upstream portion of the upper surface extends from the third panel, beyond the second panel, toward the first panel.

Further aspects, features, and advantages of the present invention will be apparent to those of ordinary skill in the art upon examining the accompanying drawings and upon reading the following Detailed Description of the Preferred Embodiments.

DETAILED DESCRIPTION OF THE PREFERRED EMBODIMENTS

Figure 1:
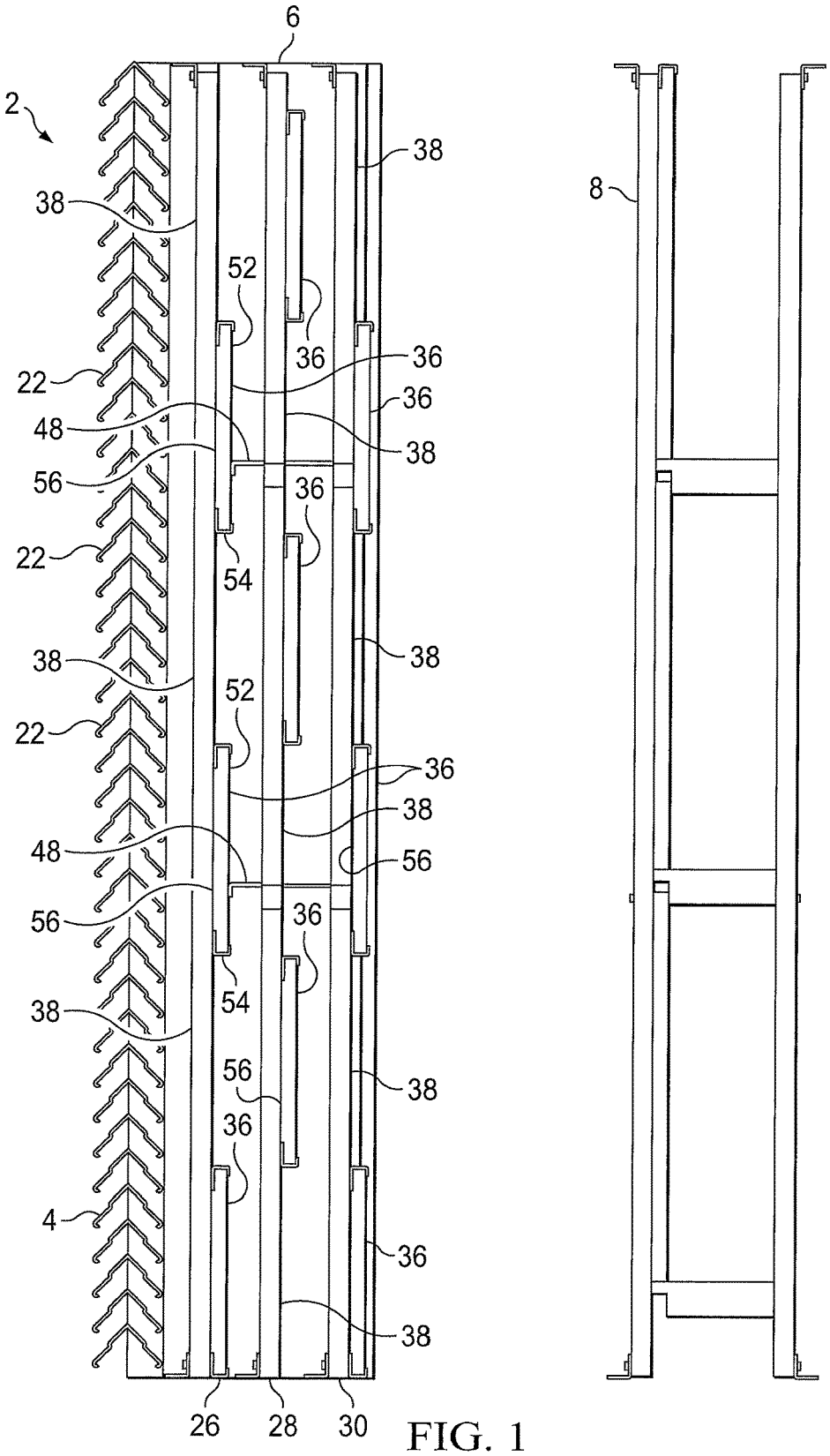
FIG. 1 is a cutaway elevational side view of an embodiment 2 of a snow removal assembly provided by the present invention.
Figure 2:
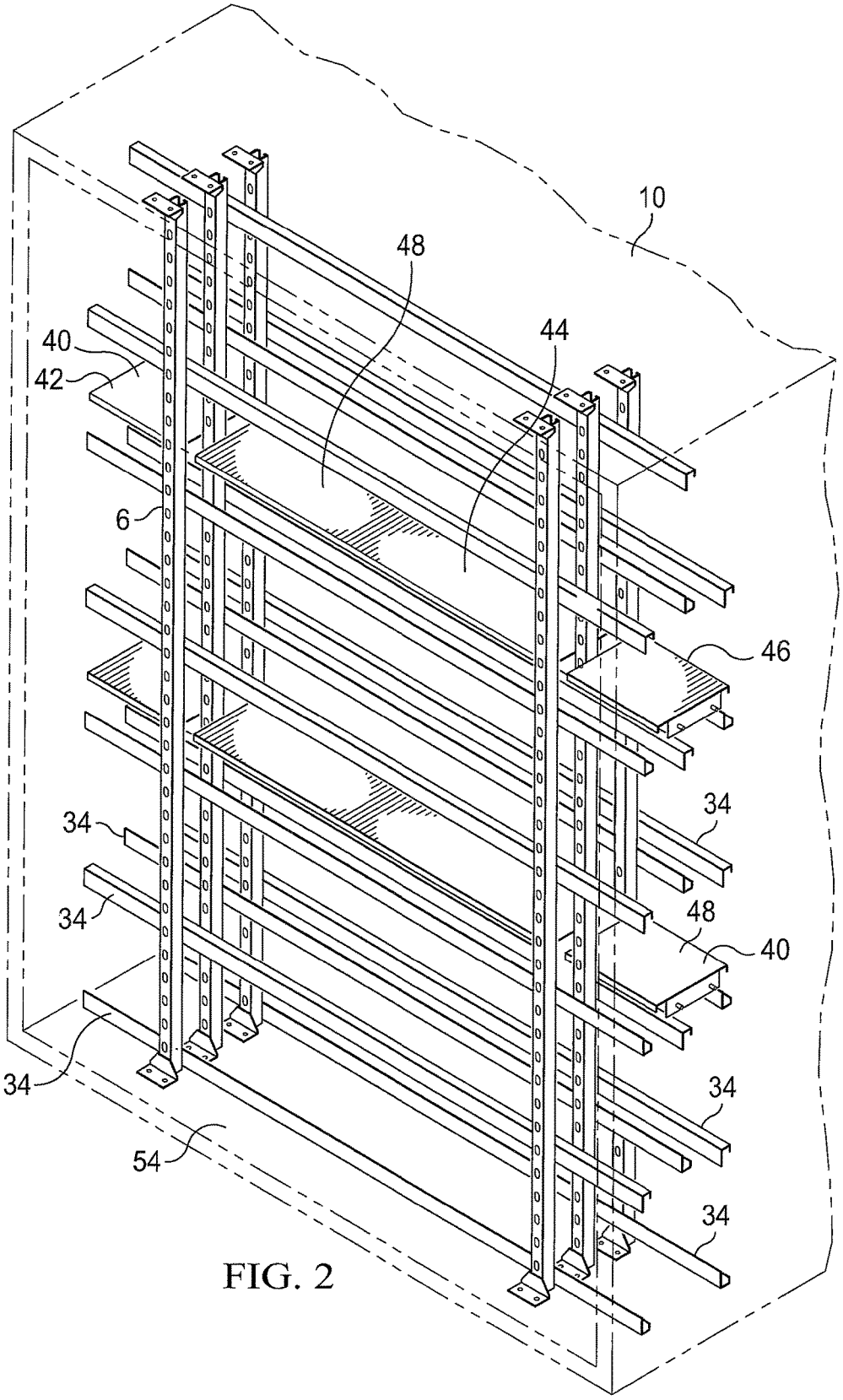
FIG. 2 is a perspective view of an embodiment 6 of an inventive snow removal fence apparatus used in the inventive snow removal assembly 2. The snow fence apparatus 6 is shown as installed in an air intake plenum 10 of an air handling unit 12. For ease of viewing the installation in FIG. 2, the filter elements 36 of the snow fence apparatus have been removed.
Figure 3:
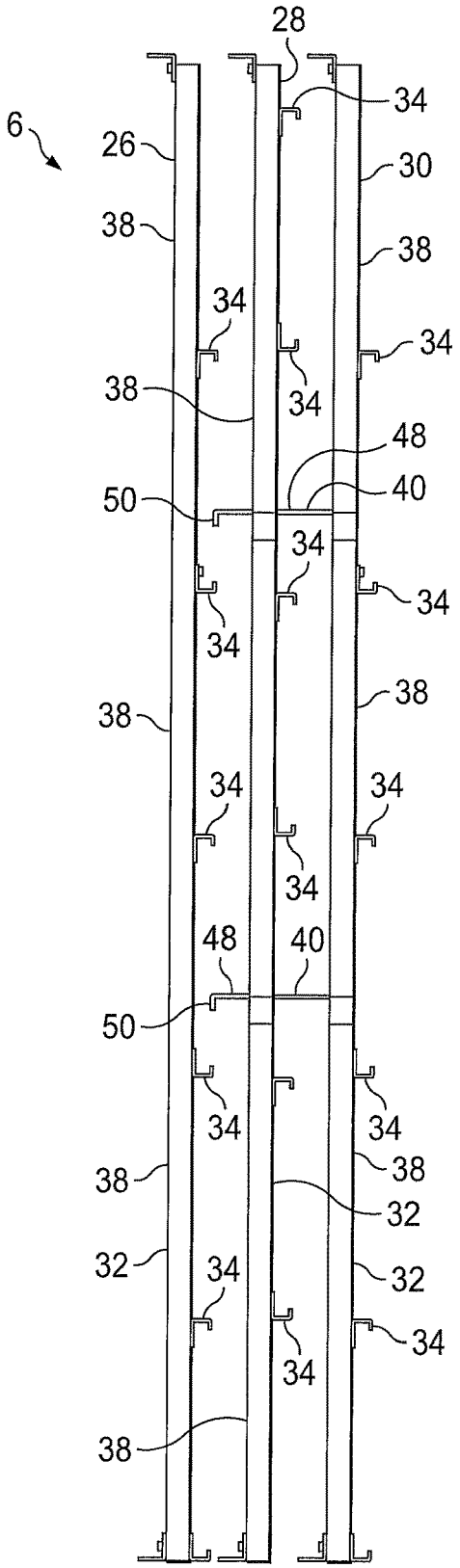
FIG. 3 is an elevational side view of the inventive snow fence apparatus 6 with the filter elements 36 thereof removed.
Figure 4:
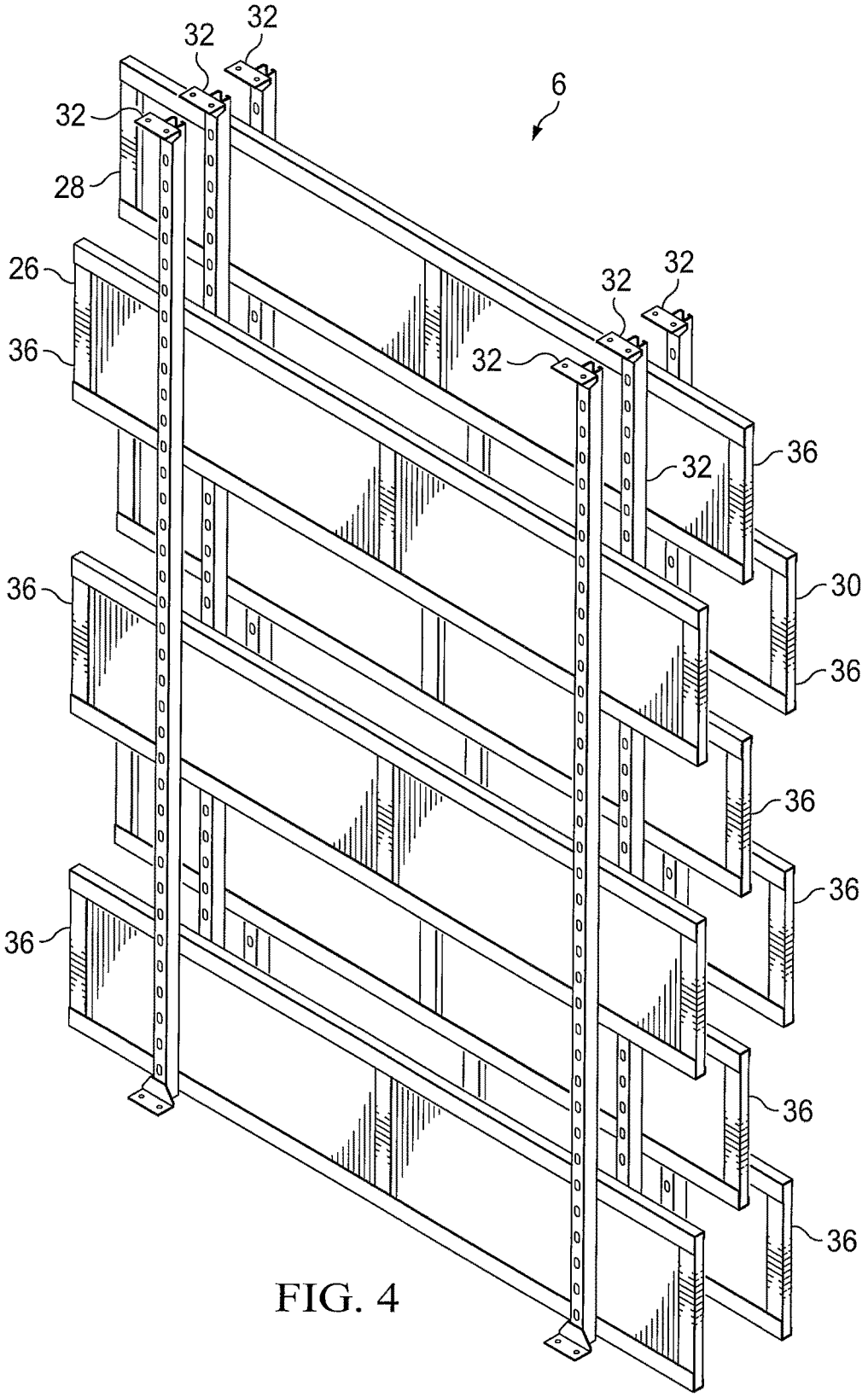
FIG. 4 is a perspective view of the inventive snow fence apparatus 6 with the filter elements 36 installed but with the snow collection pans 40 of the snow fenced 6 removed.
Figure 5:
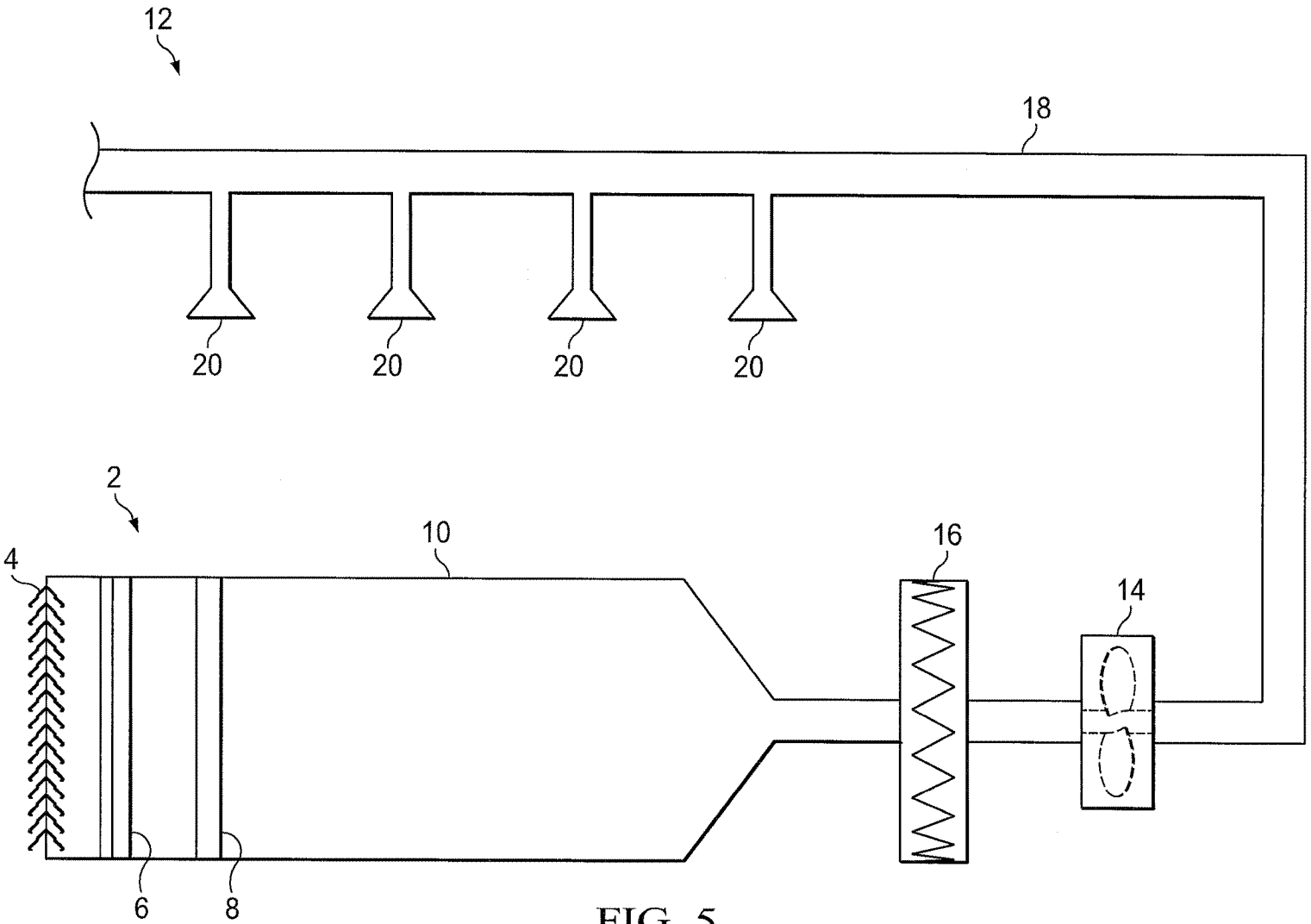
FIG. 5 schematically illustrates an embodiment 12 of an air handling unit provided by the present invention.

An embodiment 2 of the inventive assembly for removing snow from the air intake of an air handling unit (AHU) 12 is illustrated in FIGS. 1-5. The inventive snow removal assembly 2 preferably comprises: an outer louvered panel 4 or other inlet structure (e.g., a hooded or ducted opening) effective for at least blocking debris; an inventive snow removal fence apparatus 6 positioned behind (i.e., downstream of) the outer louvered panel 4; and a moisture eliminating panel 8 positioned behind (i.e., downstream of) the inventive snow fence apparatus 6. The inventive snow removal assembly 2 can be located inside the air intake plenum 10 of the AHU 12. By way of example, but not by way of limitation, the AHU 12 can be a HVAC system.

In addition to the inventive snow removal assembly 2, the AHU 12 further comprises: at least one air fan or blower 14 downstream of the snow removal assembly 2; one or more heating elements, dehumidifiers, or other air treatment elements 16 in the air flow path between the snow removal assembly 2 and the fan(s) 14; one or more air flow ducts 18 which deliver the air from the fan(s) 14 to desired locations in the building; and outlet vents 20 from which the air from the flow duct(s) 18 is discharged into the building.

The inventive snow fence apparatus 6 is positioned behind the inlet structure 4 and preferably includes a plurality of adjacent, parallel, vertically extending fence panels 26, 28, 30. Each of the snow fence panels 26, 28, 30 preferably comprises: (a) at least two unistrut assemblies or other filter mounting rod or rail structures 32 which are vertically installed in the air intake plenum 10, (b) a plurality of horizontally extending filter holding brackets 34 attached to the mounting rod or rail structures 32, and (c) a plurality of filter elements 36 which are retained by the holding brackets 34 such that each filter element 36 preferably extends horizontally across substantially the entire width of the fence panel 26, 28, 30. The holding brackets 34 and the filter elements 36 can be positioned on either side of the mounting rod or rail structures 12 but are preferably positioned on the downstream sides of the mounting structures 32.

The filter elements 36 are preferably elongate elements, most preferably having a rectangular shape, which are mounted on the mounting rod or rail structures 32 such that each snow fence panel 26, 28, 30 comprises a vertical series of alternating filter areas 36 and open areas 38. The filter areas 36 and the open areas 38 preferably extend horizontally across substantially the entire width of the fence panel 26, 28, 30. The size and number of the filter elements 36 in each fence panel 26, 28, 30 are preferably such that the open areas 38 comprise from about 35% to about 65% of the total face area of the fence panel 26, 28, 30. The open areas 38 more preferably comprise from about 45% to about 55% and most preferably comprise about 50% of the total face area of the fence panel 26, 28, 30.

The fence panels 26, 28, and 30 preferably also have alternating filter element placements so that (a) the filter areas 36 of an upstream fence panel will be positioned in front of and in alignment with the open areas 38 of the next succeeding fence panel and (b) the open areas 38 of the upstream fence panel will be positioned in front of and in alignment with the filter areas 36 of the next succeeding fence panel.

Consequently, in the inventive snow fence apparatus 6 shown in FIGS. 1-5 having an upstream fence panel 26, a middle fence panel 28, and a downstream fence panel 30, the filter areas 36 of the upstream panel 26 are positioned in front of and in alignment with the open areas 38 of the middle fence panel 28, which are in turn positioned in front of and in alignment with the filter areas 36 of the downstream panel 30. At the same time, the open areas 38 of the upstream panel 26 are positioned in front of and in alignment with the filter areas 36 of the middle fence panel 28, which are in turn positioned in front of and in alignment with the open areas 38 of the downstream panel 30.

The inventive snow fence apparatus 6 preferably also comprises one or more horizontal snow collection pans 40. Each snow collection pan 40 is preferably an elongate panel element which provides, or an elongate series of horizontal panel element pieces 42, 44, 46 which provides, a flat, horizontal upper snow collection surface 48 which preferably extends across substantially the entire width of the snow fence apparatus 6. Each snow collection pan 40 preferably extends forwardly (i.e., extents in an upstream direction) from the last fence panel 30 and has a forward edge 50 which will touch, or will be in close proximity to (i.e., preferably within from 0 to 3 inches of) the rearward (i.e., downstream) surface 52 of a filter element 36 installed on the first fence panel 26.

In the inventive snow fence apparatus 6, the lowermost filter element 36 of the first fence panel 26 is preferably installed at or in close proximity to (i.e., preferably within 0 to 3 inches of) the bottom surface 54 of the air intake plenum 10 so that the bottom interior surface 54 of the plenum 10 effectively operates as a horizontal snow collection pan behind the lowermost filter element 36 of the first fence panel 26. Consequently, in order to provide snow collection pans 40 behind the remaining filter elements 36 of the first fence panel 26, the number of snow collection pans 40 installed in the inventive snow fence apparatus 6 will preferably be equal to the total number of filter elements 36 in vertical series in the first fence panel 26 minus 1. Each snow collection pan 40 will preferably be located behind one of the filter elements 36 in the first fence panel 26 and will most preferably be elevationally positioned so that the upper surface 48 of the snow collection pan 40 is at substantially the same elevation as, or is positioned within one third of the installed vertical height of the filter element 36 above, the bottom edge 54 of the filter element 36.

Figure 6:
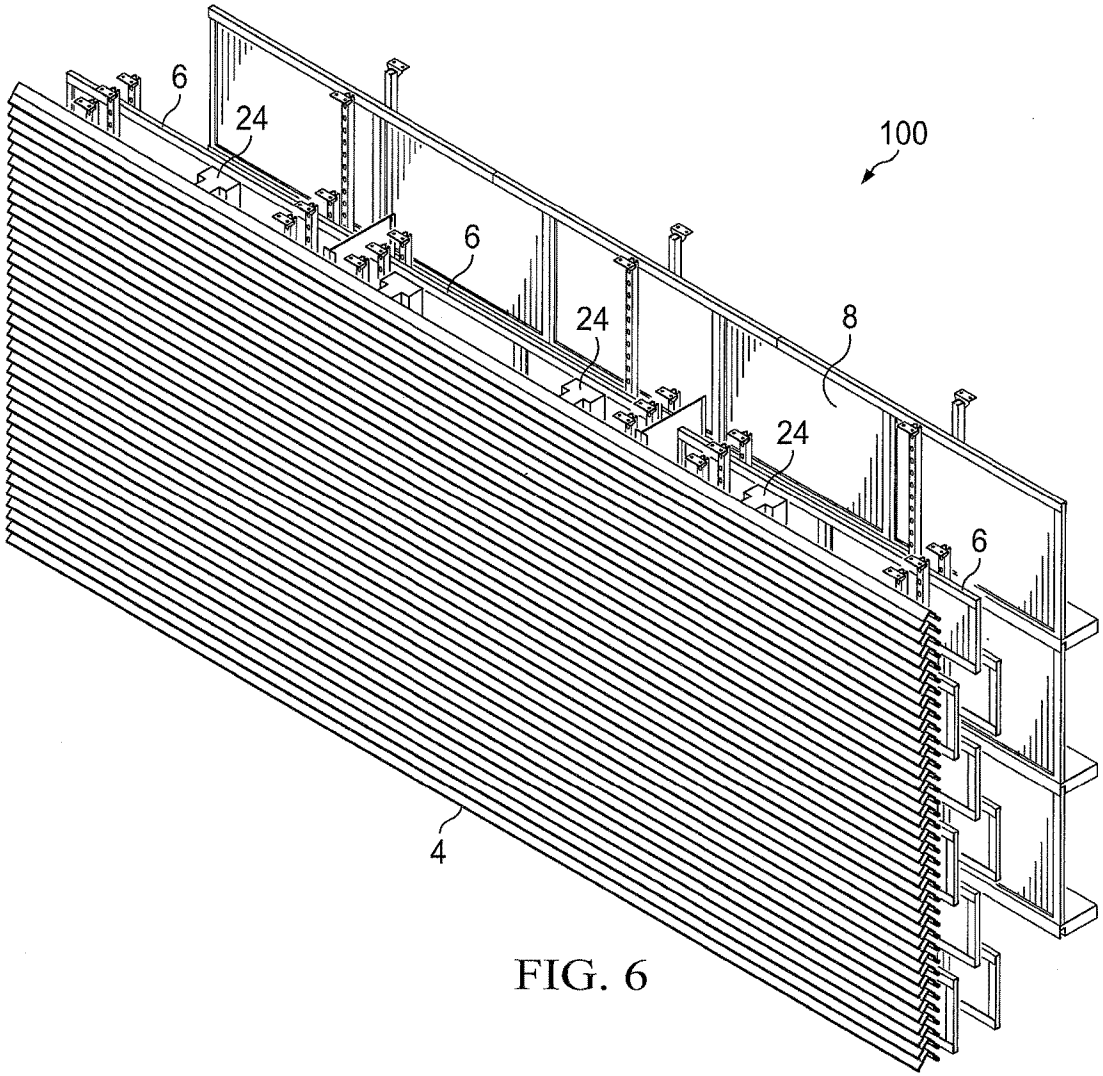
FIG. 6 is a perspective view of an alternative embodiment 100 of the inventive snow removal assembly comprising three of the inventive snow fence apparatuses 6 positioned side-by-side for installation in an air intake plenum of greater width.
Figure 7:
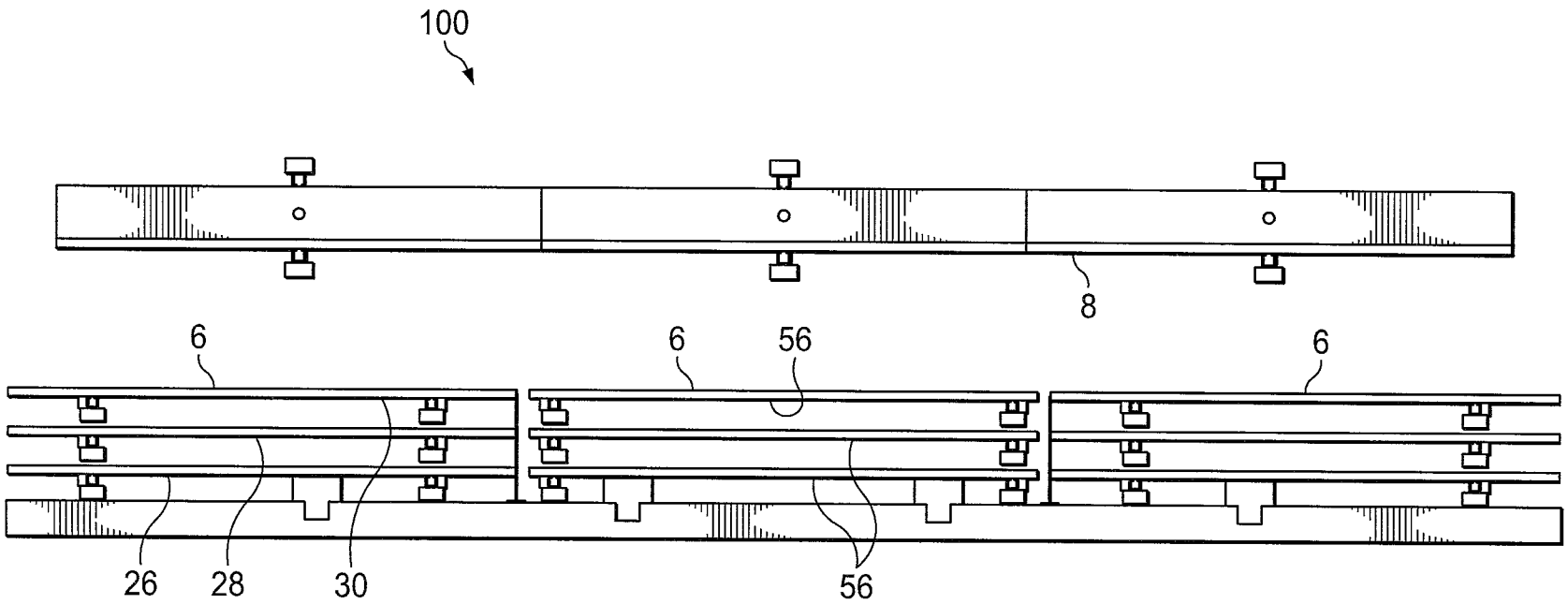
FIG. 7 is a plan view of the inventive snow removal assembly 100.
Figure 8:
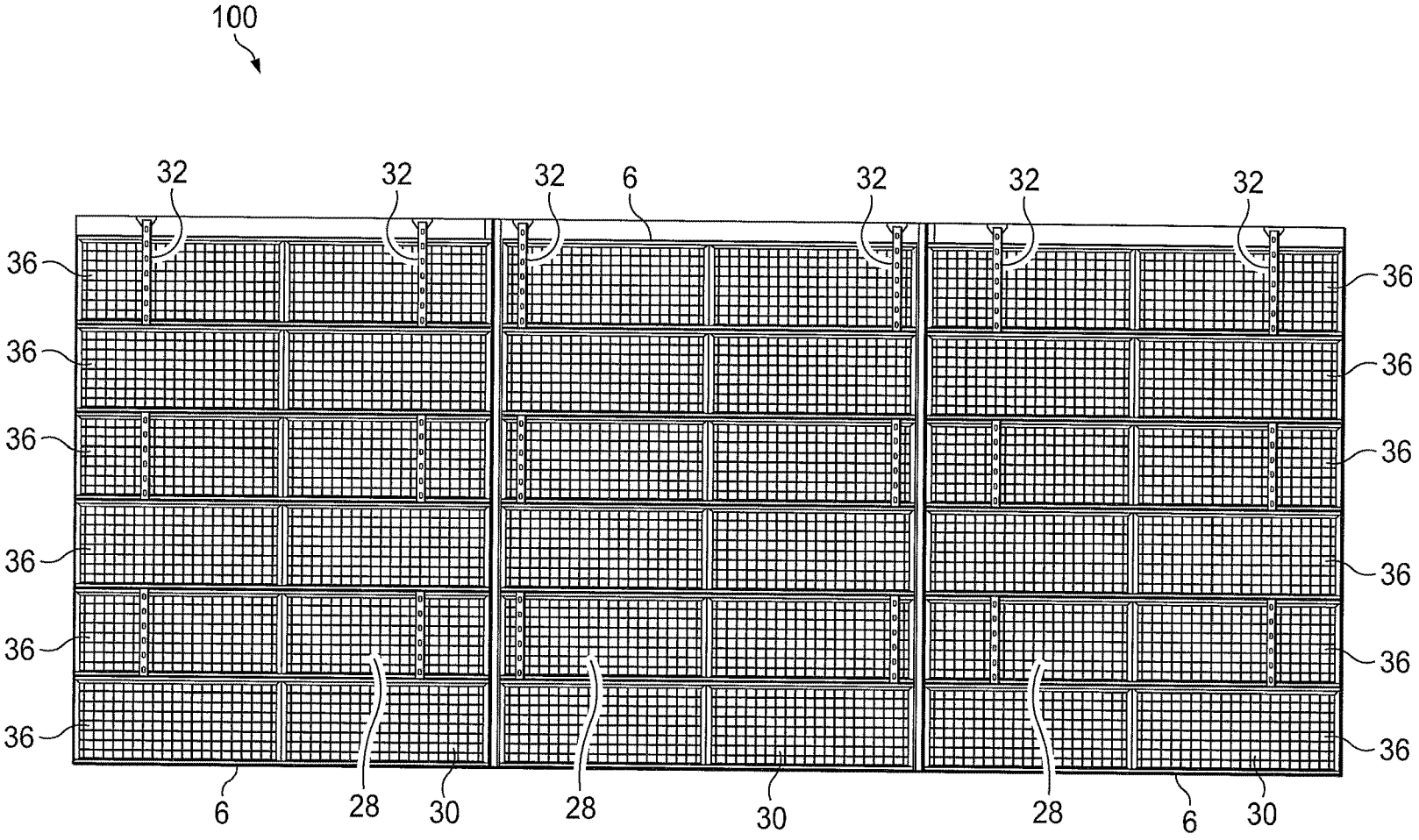
FIG. 8 is an elevational rear view of the snow fence apparatuses 6 installed side-by-side in the inventive snow removal assembly 100.

Although the inventive snow removing assembly 2 shown in FIGS. 1-4 includes only a single snow fence apparatus 6 which extends across substantially the entire width of the air intake duct 10, it will be understood that, for wider air intake ducts, the inventive snow removing assembly 2 can include a plurality of snow fence apparatuses 6 installed side-by-side across the width of the duct 10. By way of example, an alternative embodiment 100 of the inventive snow removal assembly including three of the inventive snow fence apparatuses 6 installed side-by-side is illustrated in FIGS. 6-8.

During a snow event, the inventive snow fence apparatus 6 removes the snow from the intake air stream for the AHU by both (a) impaction and (b) pressure differential. As intake air initially flows through the filter elements 36 of the fence panels 26, 28, and 30, the snow in the intake air stream will collect on the forward faces of the filter elements 36. However, if the intake air contains an excessive amount of snow which eventually clogs the filter elements 36 so that the flow of air through the filter elements 36 is severely restricted or blocked, the intake air will instead follow in an alternating path around the filter elements 36 through the open areas 38 of the successive fence panels 26, 28, and 30.

As a result, each of the clogged filter elements 36 acts as a barrier behind which a low pressure zone is created. As the intake air travels through these low pressure zones, the snow separates from the air and falls onto the horizontal snow collection pans 40, which retain the snow in the low pressure zones. Consequently, even when the filter elements 36 are clogged, the inventive snow fence 6 removes the snow from the intake air stream while also minimizing pressure drop in the air stream by continuing to provide a free flow area (i.e., a total area of the open areas 38 in each panel) of from about 35% to about 65%, more preferably from about 45% to about 55% and most preferably about 50%, of the cross-sectional area of the intake air plenum 10.

The filter elements 36 of the inventive snow fence assembly 6 are preferably formed of a lightweight, low density, coalescing mesh. When clean and dry, the pressure drop though the filter mesh is negligible. The mesh preferably comprises a mass of metal strands prepared by knitting and crimping the component wire and subsequently layering the knitted mesh into a pad.

The thickness of the mesh filter elements 36 will preferably be in the range of from about 8 to about 10 layers, more preferably 10 layers. The density of the mesh pad material used in the filter elements 36 will be determined by the number of layers of mesh fabricated into the pad.

The filter mesh pad material is preferably formed of stainless steel of various wire gauges. Wire gauges of from about 0.006 inches to about 0.01 inches, more preferably 0.006 inches, is/are suitable for the filter elements 36, although this can vary depending upon the desired mesh density and depth.

In the inventive snow fence assembly 6, the fence panels 26, 28, and 30 can be spaced apart by any distance which is effective for (a) filtering snow from the intake air and (b) creating low pressure zones behind the filter elements 36, as explained below, in the event that the filter elements 36 become clogged. The fence panels 26, 28 and 30 will preferably be spaced apart such that the distance from the upstream (i.e., forward) face 56 of the filter elements 36 in an upstream fence panel 26 or 28 to the upstream face 56 of the filter elements 36 in the next succeeding downstream fence panel 28 or 30 will not be more than 30 inches, will more preferably be in the range of from about 12 to about 24 inches, will more preferably be in the range of from about 15 to about 21 inches, and will more preferably be about 18 inches. Also, the distance from the louvered panel 4 or other inlet structure to the upstream face 56 of the filter elements 36 of the first fence panel 26 will preferably be not more than 30 inches, will more preferably be in the range of from about 12 to about 24 inches, and will more preferably be in the range of from about 15 to about 21 inches.

The moisture eliminating panel 8 positioned behind (i.e., downstream of) the inventive snow fence apparatus 6 will preferably comprise a mesh pad material, similar to that described above, for removing any residual snow and moisture. The moisture eliminating panel 8 will more preferably be a moisture eliminating panel element of the type known in the art which further comprises one or more heating elements, preferably on the intake side of mesh pad 6. An example of a commercially available moisture eliminator which is particularly well suited for use in the inventive assembly 2 is the SnoStop® Snow Eliminator available from Mistop, a division of Acme Mfg. in Claremore, Okla.

In the inventive method for operating an AHU 12, outside air is pulled through the outer louvered panel 4 or other debris blocking structure by the fan(s) or blower(s) 14. This intake air then flows through the inventive snow removal fence apparatus 6 which removes all or at least most of the snow from the air stream. Next, the intake air flows through the moisture eliminating panel 8 which removes any residual snow or entrained water. The intake air is then delivered through a dehumidifier or other air treatment system 16 in the air flow path between the snow removal assembly 2 and the fan(s) or blowers 14. The fan(s) or blower(s) 14 then deliver the air stream through the air flow duct(s) 18 for discharge into the building via the outlet vents 20.

Thus, the present invention is well adapted to carry out the objects and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within this invention as defined by the claims.

What is claimed is:

1. An apparatus for removing snow from an intake air stream for an air handling unit comprising:

a first panel comprising a vertical series of separate filter elements mounted on or in the first panel which are spaced apart by an alternating vertical series of open flow areas through the first panel, wherein each of the separate filter elements is a mesh filter element so that air flows through each of the separate filter elements, each of the open flow areas is a free flow area for air flow, the first panel has a width, and each of the separate filter elements of the first panel and each of the open flow areas which separate the separate filter elements of the first panel extend horizontally across the width of the first panel;

a second panel adjacent to and downstream of the first panel, the second panel comprising a vertical series of separate filter elements mounted on or in the second panel which are spaced apart by an alternating vertical series of open flow areas through the second panel, wherein each of the separate filter elements of the second panel is a mesh filter element so that air flows through each of the separate filter elements of the second panel, each of the open flow areas of the second panel is a free flow area for air flow, the second panel has a width, and each of the separate filter elements of the second panel and each of the open flow areas which separate the separate filter elements of the second panel extend horizontally across the width of the second panel;

each of the open flow areas of the second panel being positioned behind and in alignment with one of the filter elements of the first panel;

each of the filter elements of the second panel being positioned behind and in alignment with one of the open flow areas of the first panel; and the second panel is spaced a distance downstream of the first panel which creates reduced pressure zones behind the filter elements of the first panel when air flow through the filter elements of the first panel is blocked by snow; wherein the first panel and the second panel extend upwardly from a horizontal support surface, the vertical series of the separate filter elements of the first panel comprises a lowermost first one of the filter elements of the first panel and a second one of the filter elements of the first panel which is positioned above the lowermost first one of the filter elements of the first panel and is spaced vertically apart from the lowermost first one of the filter elements of the first panel by one of the open flow areas of the first panel, a bottom edge of the lowermost one of the filter elements of the first panel is positioned at or in close proximity to the horizontal support surface, the apparatus further comprises a snow collection pan, which is different from and is spaced upwardly from the horizontal support surface, having an upper surface wherein at least an upstream portion of the upper surface of the snow collection pan extends from the second panel toward the second one of the filter elements of the first panel and the upper surface of the snow collection pan is positioned at an elevation in the apparatus which is substantially the same as an elevation of a bottom edge of the second one of the filter elements of the first panel or is higher than the elevation of the bottom edge of the second one of the filter elements of the first panel by a distance which is not more than ⅓ of an installed vertical height of the second one of the filter elements of the first panel.

2. The apparatus of claim 1 wherein:

the filter elements of the first panel have upstream faces and the filter elements of the second panel have upstream faces which are from 12 to 30 inches downstream of the upstream faces of the filter elements of the first panel.

3. The apparatus of claim 1 wherein:

a total area of the open flow areas of the first panel is from 45% to 55% of a total face area of the first panel and a total area of the open flow areas of the second panel is from 45% to 55% of a total face area of the second panel.

4. The apparatus of claim 1 wherein the snow collection pan comprises one pan segment or a series of adjacent pan segments which extends across the width of the first panel.

5. The apparatus of claim 1 further comprising:

a third panel adjacent to and downstream of the second panel, the third panel comprising a vertical series of separate filter elements mounted on or in the third panel which are spaced apart by an alternating vertical series of open flow areas through the third panel, wherein each of the separate filter elements of the third panel is a mesh filter element so that air flows through each of the separate filter elements of the third panel, each of the open flow areas of the third panel is a free flow area for air flow, the third panel has a width, and each of the separate filter elements of the third panel and each of the open flow areas which separate the separate filter elements of the third panel extend horizontally across the width of the third panel;

each of the open flow areas of the third panel being positioned behind and in alignment with one of the filter elements of the second panel;

each of the filter elements of the third panel being positioned behind and in alignment with one of the open flow areas of the second panel; and the third panel is spaced a distance downstream of the second panel which creates reduced pressure zones behind the filter elements of the second panel when air flow through the filter elements of the second panel is blocked by snow.

6. The apparatus of claim 5 wherein:

the filter elements of the first panel have upstream faces;

the filter elements of the second panel have upstream faces which are from 12 to 30 inches downstream of the upstream faces of the filter elements of the first panel; and the filter elements of the third panel have upstream faces which are from 12 to 30 inches downstream of the upstream faces of the filter elements of the second panel.

7. The apparatus of claim 5 wherein:

the first, second and third panels extend upwardly from the horizontal support surface, wherein the upstream portion of the upper surface of the snow collection pan extends from the third panel, through the second panel, toward the second one of the filter elements of the first panel.

8. The apparatus of claim 7 wherein:

a total area of the open flow areas of the first panel is from 45% to 55% of a total face area of the first panel;

a total area of the open flow areas of the second panel is from 45% to 55% of a total face area of the second panel; and a total area of the open flow areas of the third panel is from 45% to 55% of a total face area of the third panel.

9. The apparatus of claim 7 wherein the first panel, the second panel, and the third panel are positioned inside an air intake plenum of an air handling unit.

10. The apparatus of claim 7 wherein:

the vertical series of the separate filter elements of the first panel further comprises a third one of the filter elements of the first panel which is positioned above the second one on the filter elements of the first panel and is spaced vertically apart from the second one of the filter elements of the second panel by one of the open flow areas of the first panel, the elevated snow collection pan is a first elevated snow collection pan, and the apparatus further comprises a second snow collection pan, which is different and is spaced upwardly from the first elevated snow collection pan, having an upper surface wherein at least an upstream portion of the upper surface of the second elevated snow collection pan extends from the third panel, through the second panel, toward the third one of the filter elements of the first panel.

11. The apparatus of claim 10 further comprising a debris blocking structure upstream of the first panel.

12. The apparatus of claim 10 wherein the upper surface of the second snow collection pan is positioned at an elevation which is substantially the same as an elevation of a bottom edge of the third one of the filter elements of the first panel or is higher than the elevation of the bottom edge of the third one of the filter elements of the first panel by a distance which is not more than ⅓ of an installed vertical height of the third one of the filter elements of the first panel.

13. The apparatus of claim 7 further comprising a moisture removal element positioned downstream of the third panel.

14. The apparatus of claim 1 wherein:

the first panel further comprises at least two vertically extending filter mounting structures and a plurality of horizontally extending bracket elements attached to the vertically extending filter mounting structures, wherein the filter elements of the first panel are mounted in the horizontally extending bracket elements and the second panel further comprises at least two vertically extending filter mounting structures and a plurality of horizontally extending bracket elements attached to the vertically extending filter mounting structures of the second panel, wherein the filter elements of the second panel are mounted in the horizontally extending bracket elements of the second panel.

15. The apparatus of claim 1 wherein each of the filter elements of the first panel and each of the filter elements of the second panel is a wire mesh filter element having a wire gauge in a range of from 0.006 to 0.01 inches.

16. The apparatus of claim 5 wherein:

the first panel further comprises at least two vertically extending filter mounting structures and a plurality of horizontally extending bracket elements attached to the vertically extending filter mounting structures, wherein the filter elements of the first panel are mounted in the horizontally extending bracket elements, the second panel further comprises at least two vertically extending filter mounting structures and a plurality of horizontally extending bracket elements attached to the vertically extending filter mounting structures of the second panel, wherein the filter elements of the second panel are mounted in the horizontally extending bracket elements of the second panel, and the third panel further comprises at least two vertically extending filter mounting structures and a plurality of horizontally extending bracket elements attached to the vertically extending filter mounting structures of the third panel, wherein the filter elements of the third panel are mounted in the horizontally extending bracket elements of the third panel.

17. The apparatus of claim 5 wherein each of the filter elements of the first panel, each of the filter elements of the second panel, and each of the filter elements of the third panel is a wire mesh filter element having a wire gauge in a range of from 0.006 to 0.01 inches.

* * * * *